US007556454B2

(12) United States Patent
Cable et al.

(10) Patent No.: US 7,556,454 B2
(45) Date of Patent: Jul. 7, 2009

(54) IRREGULARLY SURFACED H PILE

(75) Inventors: Edward Cable, Blytheville, AR (US); Mark Petitgoue, Dyersburg, TN (US)

(73) Assignee: Nucor Yamato Steel Company, Amorel, AR (US)

( * ) Notice: Subject to any disclaimer, the term of this patent is extended or adjusted under 35 U.S.C. 154(b) by 0 days.

(21) Appl. No.: 11/161,806

(22) Filed: Aug. 17, 2005

(65) Prior Publication Data

US 2006/0110220 A1 May 25, 2006

Related U.S. Application Data

(63) Continuation-in-part of application No. 10/994,037, filed on Nov. 19, 2004, now abandoned.

(51) Int. Cl.
*E02D 5/22* (2006.01)

(52) U.S. Cl. ..... 405/254; 405/231

(58) Field of Classification Search ..... 405/231, 405/254

See application file for complete search history.

(56) References Cited

U.S. PATENT DOCUMENTS

| | | | | |
|---|---|---|---|---|
| 2,246,578 | A * | 6/1941 | De Salardi | 428/593 |
| 2,605,867 | A * | 8/1952 | Goodwin | 52/364 |
| 3,333,429 | A | 8/1967 | Dougherty | |
| 3,335,596 | A * | 8/1967 | Iknya et al. | 72/194 |
| 3,691,776 | A | 9/1972 | Hull | |
| 3,810,363 | A | 5/1974 | Dar Conte | |
| 3,939,665 | A | 2/1976 | Gosse et al. | |
| 4,244,156 | A | 1/1981 | Watts, Jr. | |
| 4,355,927 | A | 10/1982 | Stephan | |
| 4,464,083 | A | 8/1984 | Wathey | |
| 4,818,148 | A | 4/1989 | Takeda et al. | |
| 5,823,042 | A * | 10/1998 | Snyder et al. | 72/366.2 |
| 6,019,549 | A | 2/2000 | Blair et al. | |
| 6,219,990 | B1 | 4/2001 | Snyder et al. | |

FOREIGN PATENT DOCUMENTS

GB 1151293 5/1969

OTHER PUBLICATIONS

Nucor Yamato Steel Company, "Notification of Transmittal of the International Search Report and the Written Opinion of the International Search Authority, or the Declaration," May 8, 2006.

* cited by examiner

*Primary Examiner*—Frederick L Lagman
(74) *Attorney, Agent, or Firm*—Moore & Van Allen PLLC; Andrew L. Haynes

(57) ABSTRACT

A steel H pile has a relief design embossed on one or more major surfaces of either or both of its steel flanges and its web to provide surface irregularities thereon which increase the pile's surface friction and its friction pile load bearing capacity.

8 Claims, 4 Drawing Sheets

FIG. 1
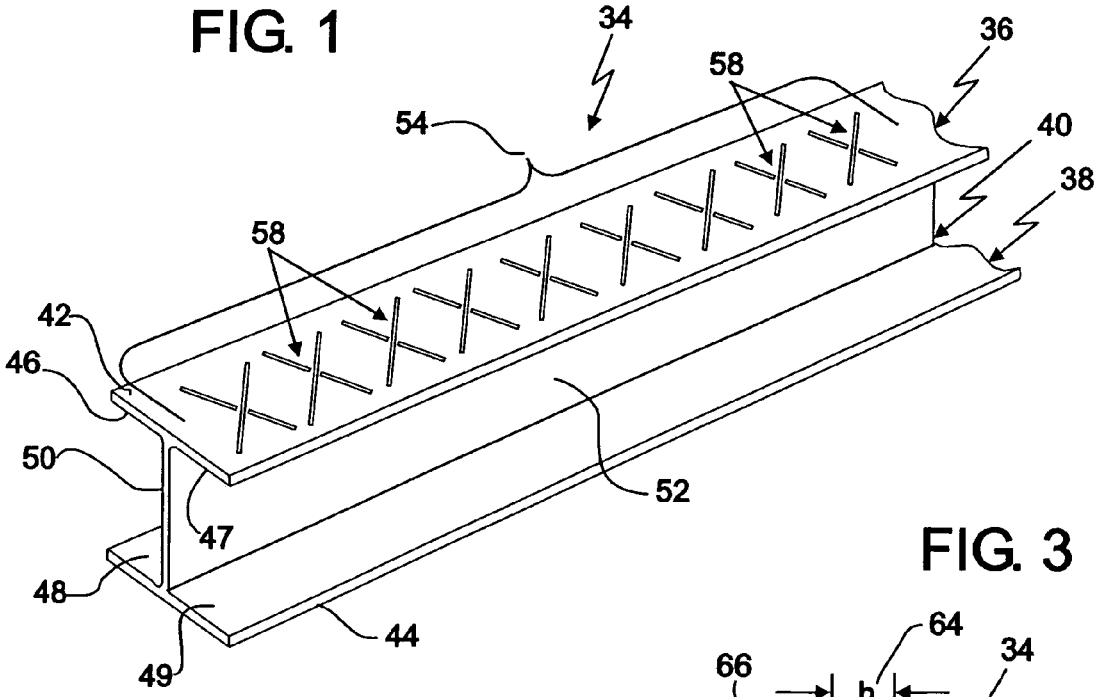
FIG. 3
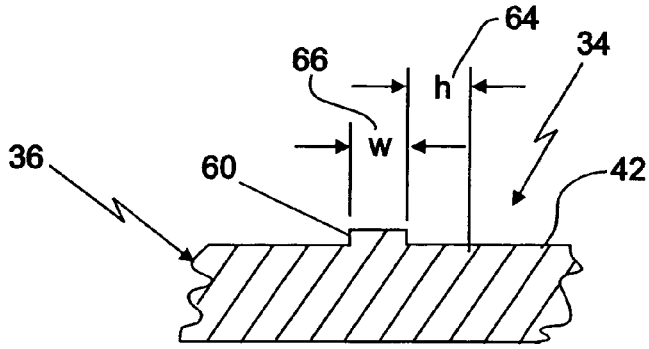
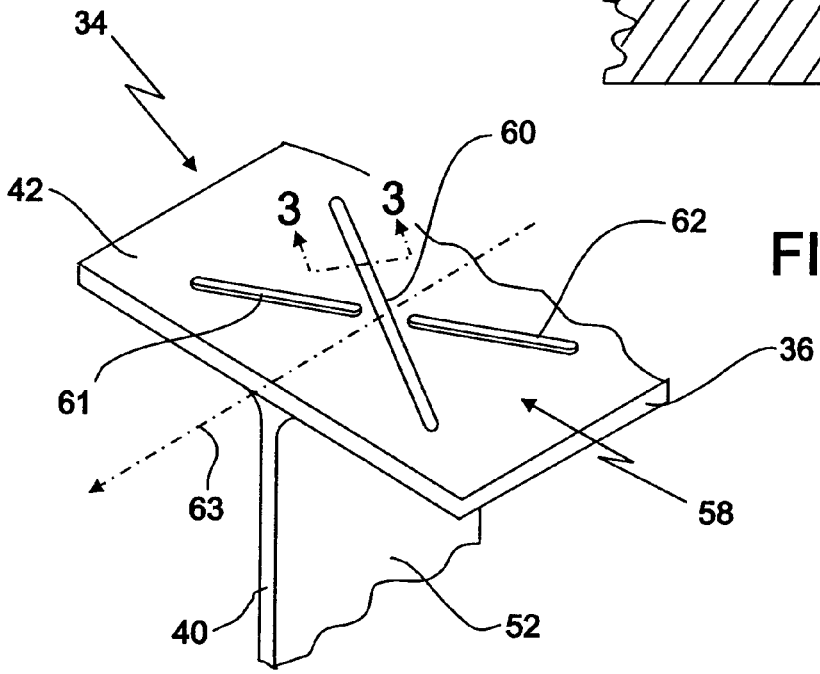
FIG. 2

FIG. 10
Prior Art
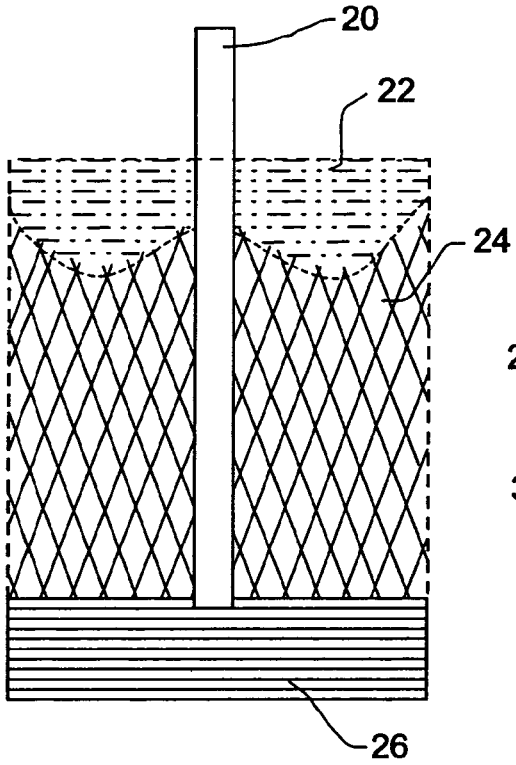
FIG. 11
Prior Art
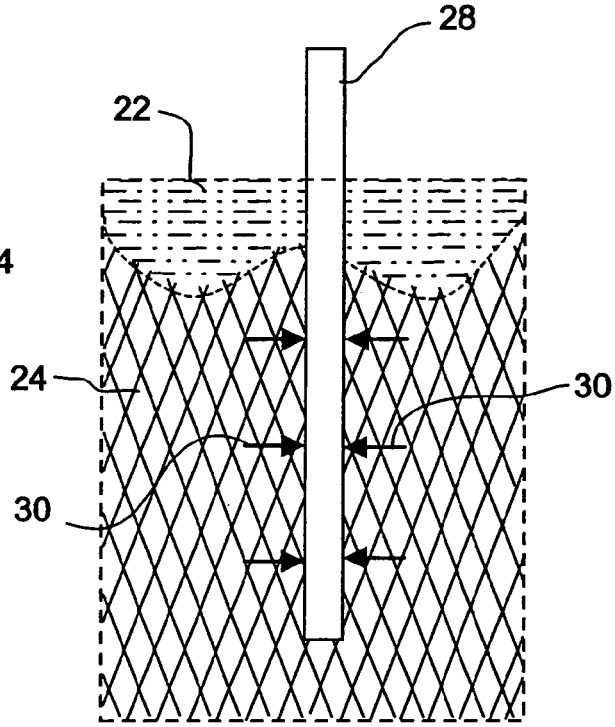
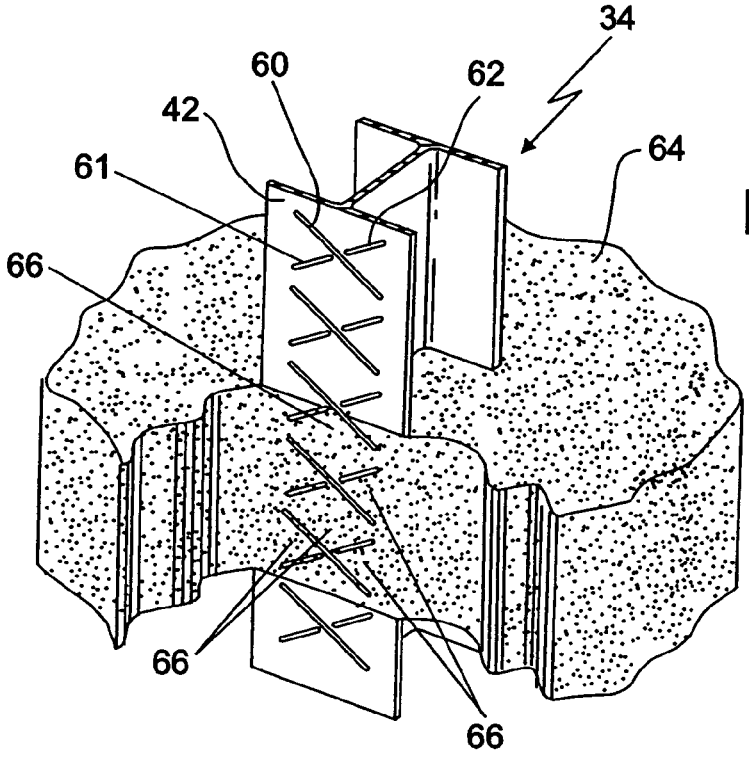
FIG. 4

IRREGULARLY SURFACED H PILE

CROSS REFERENCE TO RELATED APPLICATIONS

This application is a continuation in part of, and claims priority from, commonly assigned patent application Ser. No. 10/994,037, entitled IRREGULARLY SURFACED H PILING, and filed Nov. 19, 2004 by Edward Cable et al. now abandoned; the entire disclosure of which is incorporated here by reference.

TECHNICAL FIELD

This invention relates to load bearing foundation piles, and more particularly to steel H- piles. Background Art As known, pile foundation systems are used to carry and transfer the load of a structure (building, bridge, or other type structure) to soils below the ground surface when the near surface soil is unsuitable to carry the load. They function to transmit the load to more solid soil layers and/or bedrock, and are typically installed by being driven (hammered) or drilled into the ground.

Foundation piles develop their load carrying capacity in two ways. One way is by having the pile's bottom end (or pile tip) come to rest on solid substratum that is hard or dense enough to carry the load, such as dense sand, dense gravel, hard clay or bedrock. This type of installation is known as an end-bearing pile, and it derives its load carrying capacity from the penetration resistance of the soil at the toe of the pile. In this type of installation, the structural load is transferred through the pile to the bedrock, although some of the load imposed on the pile may be transferred to the surrounding soil through the surface friction of its shaft. End bearing piles structurally behave as columns. The other type of pile installation is the friction pile, which has little or no end bearing release of force but instead supports its load almost entirely through the frictional forces generated between the pile's shaft and the surrounding soil.

These different pile installations are illustrated schematically in FIGS. 10 and 11. FIG. 10 shows an end bearing pile load 20 which is driven through relatively loose sandy upper soil 22 and lower level clay soil 24 into a hard or dense bearing strata 26 (e.g. dense sand, gravel, hard clay, or bedrock). The pile 20 transmits the surface load to the bearing strata 26. FIG. 11 illustrates a pile 28 which is also driven through the soft upper soil 22 and lower level clay soil 24, but does not reach end bearing strata at its driven depth. Here the entire surface load is transmitted into the surrounding soil through the frictional forces 30 produced by interaction of the pile shaft with the surrounding soil, which resists its downward movement.

While the end bearing pile load may be the preferred installation, it is not always possible to achieve since suitable bearing layers may be too far below the surface to be founded on economically. In those instances, friction piles are the only choice. The magnitude of the resisting force produced along the sides of a friction pile load is proportional to the amount of soil displaced by the pile. Large displacement piles have the highest frictional resistance. Driven concrete piles typically have significant frictional load carrying capacities since they displace large amounts of soil and have a rough textured surface. They are, however, harder to drive.

Hollow steel pipe piles have a smoother surface than concrete piles but they possess high load bearing capacities due to the combination of their high frictional resistance characteristics, as provided by their combined outside and inside surfaces areas, as well as their end bearing capacities which develop as the pipe is driven through more dense soils that plug the lead end of the pipe. The smoother surface makes pipe piles easier to drive than concrete piles, and while they do not have the same load bearing capacities as the concrete piles, the balance they provide between ease of installation and load carrying capacity gives them broad application.

In contrast to the concrete and steel pipe piles, the steel H pile, with the relatively small cross section of its flanges and connecting web, neither displaces large amounts of soil nor compacts sufficiently large amounts of soil beneath its lead end to achieve significant end bearing resistance. This low volume soil displacement provides the H pile with easier driving characteristics than the other types of piles, allowing their installation to greater depths, where there is a likelihood of finding bedrock or relatively dense or hard layer soils that establish their end bearing resistance. These same parameters, however, limit the use of steel H piles for friction load bearing applications.

It is desirable, therefore, to provide a steel H pile design which has the driving efficiencies of the small volume, but which offers surface friction properties capable of allowing the H pile to support greater magnitude structural loads in a variety of friction pile load applications.

Disclosure of Invention

One object of the present invention is to provide an improved steel H pile that will have an increased load carrying capacity. A further object of the present invention is to provide a steel H pile having a greater friction pile load bearing capacity. A still further object of the present invention is to provide a steel H pile in which the friction along its surfaces may be varied in magnitude, as desired, to provide a steel H pile with friction load bearing characteristics that are custom designed for the soil in which it will be installed. A yet still further object of the present invention is to provide a method of manufacturing the improved steel H pile of the present invention.

According to one aspect of the present invention, a steel H pile of the type having parallel flanges and an interconnecting web, includes a relief design embossed on an exposed surface of the H pile, the relief design comprising an array of one or more objects which project to a selected height above the base plane of the embossed surface area to provide the embossed area with surface irregularities which increase the overall surface friction of the H pile, thereby increasing its friction load bearing capacity.

In yet still further accord with this aspect of the present invention, the relief design objects are embossed along the whole or any portion of any one or all of the exposed surfaces of the H pile. In yet still further accord with this aspect of the invention, the relief design objects are arrayed within the embossed surface areas in any of a plurality of desired patterns and in any desired unit area densities.

The present invention provides an H-Piling with higher friction load bearing capabilities that permit its use in a greater variety piling applications, giving it broader utility while maintaining its efficient driving characteristics.

These and other objects, features, and advantages of the present invention will become more apparent in light of the following detailed description of a best mode embodiment thereof, as illustrated in the accompanying Drawing.

BRIEF DESCRIPTION OF DRAWINGS

FIG. 1, is a perspective illustration, not to scale, of one embodiment of a steel H pile according to the present invention;

FIG. 2, is a perspective illustration, not to scale, of a section of the H pile embodiment of FIG. 1;

FIG. 3, is a cross sectioned view taken along the lines 3-3 of FIG. 3;

FIG. 4, is a perspective illustration, in cutaway, and not to scale, of an exemplary installation of a steel H pile of the type embodied in FIG. 1;

FIG. 10, is a prior art illustration which is used in a description of the Background to the present invention;

FIG. 11, is another prior art illustration which is used in conjunction with FIG. 10 in the description of the Background to the present invention.

BEST MODE FOR CARRYING OUT THE INVENTION

Figure 5:
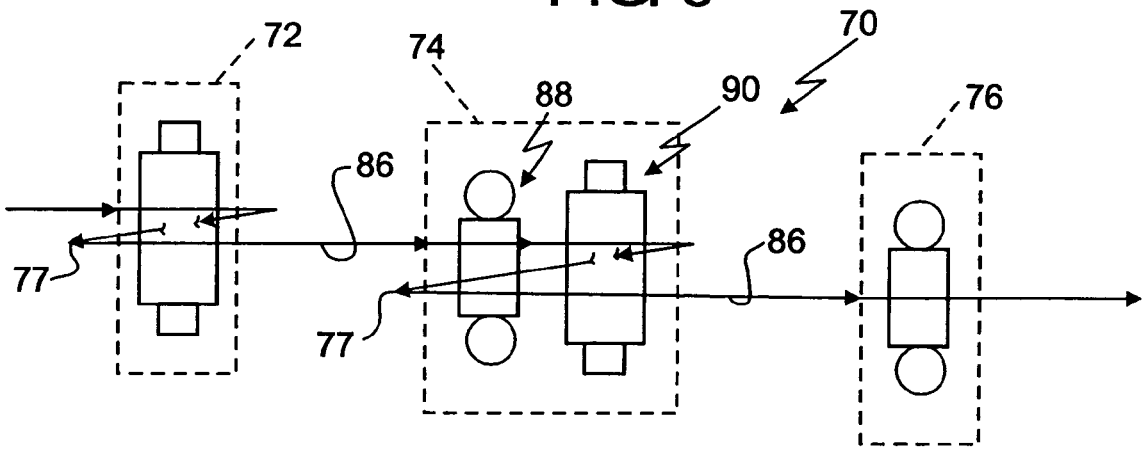
FIG. 5, is a schematic illustration of an exemplary embodiment of a rolling mill installation which may be used to produce the steel H pile according to the embodiment of FIG. 1.

In the description of the invention which follows all references to elements of the Drawing are made with the use of reference numerals which function as pointers for the reader. The same element shown in different Figures is designated by the same reference numeral in each of its several views. It should also be understood that the elements depicted in the Figures are not necessarily drawn to scale.

Referring now to FIG. 1, which is a sectioned, perspective view of one embodiment of a steel H pile 34 according to the present invention. The H pile 34 is shown to include substantially parallel flanges 36 and 38 that are interconnected substantially at their midpoints by a web portion 40. Except as distinguished hereinafter the piling 34 is identical in all respects to the prior art H piles in terms of its metallurgy and its geometry, including its exposed outer surfaces 42, 44, and inner surfaces 46-49 of the flanges 36, 38, and the surfaces 50, 52 of the web 40. The point of departure of the H pile 34 over those of the prior art is the addition of a relief design 54 which is embossed on the outer surfaces 42, 44 (the relief 54 on surface 44 not visible in FIG. 1) of the flanges 36, 38.

In the FIG. 1 embodiment the relief design 54 comprises design objects 58 arrayed in a pattern along the longitudinal axis of the outer surfaces 42, 44 of the flanges 36, 38. In a best mode embodiment the design objects are shown substantially in the form of letter "X" characters whose segments project above the plane of the surface 42 (and 44). FIG. 2 is an enlarged section of the surface 42 of the H pile 34 of FIG. 1, and shows the design object 58 segments as comprising a first linear segment 60, and bifurcated segments 61, 62. The segment 60 is positioned on the surface 42 such that its lengthwise axis extends at a selected angular orientation in respect of the longitudinal axis 63 of the flange 36. The bifurcated segments 61, 62 are positioned with their lengthwise axes extending in substantially linear registration in an opposite orientation to the longitudinal axis 63 from that of segment 60, such as to provide the object 58 with a representative "X" letter character appearance.

The relief design objects are raised so as to project at a distance above the plane of the surface 42. FIG. 3 is a section of the flange 36 taken along the line 3-3 of FIG. 2. The height (h) (64, FIG. 3) of the projection is selectable. A preferred range of height projection for the segments 60-62 is from about 0.040 inches (1 millimeter) to about 1.50 inches (38 millimeters). In the best mode embodiment of FIG. 1 the segment projected height is nominally 0.04 inches (1 millimeter). The width (W) (64, FIG. 3) of the segment is also selectable and may range from about 0.0625 inches (1.6 millimeters) to more than an inch (more than 25 millimeters). In the best mode embodiment of FIG. 1 the width is nominally 0.25 inches (6.35 millimeters).

The height projection of the relief design objects provide surface irregularity within the embossed areas of the flange surfaces 42, 44. The irregularities provide greater surface friction between the pile surfaces 42, 44 and the soil that surrounds the pile when installed since the projections provide the soil with greater gripping capabilities within the area of the relief design. As a result the frictional resistance and consequently the load bearing capacity of the H pile are increased.

FIG. 4 is a figurative, perspective illustration of the H pile 34 driven into the ground 64 such that the segments 60-62 of each of the relief design objects 58 abut and are surrounded by the subterranean soil constituents 66 such as to provide a plurality of surface contact regions which engage the soil, thereby increasing the H pile surface friction within the footprint area of the relief design, and increasing the frictional resistance of the H pile overall, thereby providing the H pile 34 with greater friction load bearing capability than that offered by prior art H piles.

Since it is understood by those skilled in the art that the realized friction pile load bearing capacity is dependent on the type soil in which the H pile is installed, the present invention allows for the amount of increased surface friction provided to the pile to be substantially infinitely variable. This is accomplished through the selection and/or variation of one or all of: (i) the projection height of the relief design objects, (ii) the shape of the relief design object, which may be any elected geometric design or alpha-numeric character type, (iii) the size of the relief design area within the H pile exposed surface (i.e. the embossed area), and (iv) the object pattern density. This allows the present H piles to be custom designed for a given load magnitude and substrata soil type.

As known to those skilled in the art, the increased surface friction resulting from the surface irregularities provided by the relief design increases both the positive and negative frictional forces acting on the pile. These forces oppose each other, with the positive force ($F_p$) being produced by the displaced soil bearing on the pile's shaft and acting to maintain the pile in position under the applied load (L), and the negative frictional force ($F_s$) being produced by soil settling down around the pile shaft with reconsolidation of the soil ("pile settling") following installation, such as to reduce the load (L) capacity of the pile. It is understood, therefore, that for friction load bearing piles the positive frictional forces must be great enough to both support the applied load and overcome the negative frictional forces, or $F_P \geqq L+F_s$. While site-by-site variations in soil determine the actual friction load bearing properties of a particular H pile design, the far greater magnitude of displaced soil to that of the settling soil allows the relief design to provide a far greater increase the absolute value of the positive frictional forces than that of the negative frictional forces, so as to produce a net increase in friction load bearing capacity.

Figure 12:
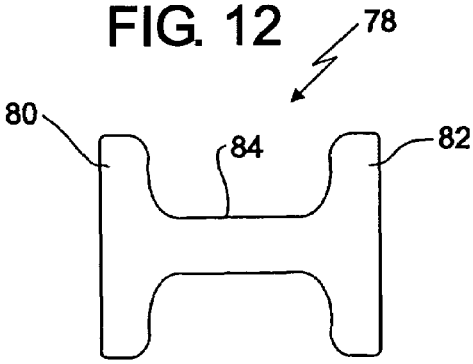
FIG. 12, is an illustration of the cross section profile of an H beam blank, as used in the description of the manufacturing method of the present invention.

The improved steel H pile of the present invention may be manufactured with slight modification to the conventional rolling methods used to manufacture prior art steel H piles. Referring now to FIG. 5, which is a schematic illustration of a conventional four stand reversing rolling mill facility 70. The facility 70 includes a breakdown mill 72, a universal roughing mill group 74, and a universal finishing mill 76. In operation, a cast steel blank (slab or ingot ) is fed from a caster (not shown) to the breakdown mill 72. The mill 72, which typically is a two high reversing mill, shapes the steel blank in several reversing passes 77 through the stand's grooved rollers to produce a beam blank 78, as shown in FIG. 12, as having parallel flanges 80, 82 connected by a web 84.

The beam blank 78 is next fed through the line 86 to the universal mill group 74, which performs the intermediate rolling. The universal mill group 74 includes a universal roughing mill 88 and a two high edging mill 90. The roughing mill 88 rolls the beam blank web 84 with its horizontal rolls to reduce its thickness, and the thickness of the beam blank flanges 80, 82 are thinned and widened in the edging mill 90. This rough-to-intermediate H pile transformation occurs over several reversing passes 77 through the mill group.

Following completion of the intermediate rolling passes the H pile has substantially the same profile and structural dimensions as prior art H piles have following completion of intermediate rolling. To this point the manufacturing steps and rolling schedule for the present H pile are the same as that which is conventional to the manufacture of prior art H piles. The present manufacturing method's point of departure from the prior art occurs in the finishing mill 76. As in the manufacture of conventional H piles the finishing stand's horizontal and vertical rolls continue to reduce the thickness of the intermediate H pile's web and flanges to the specified limits, but in addition they perform an added embossing function which imprints the selected relief design onto the H Piling surface.

Figure 6:
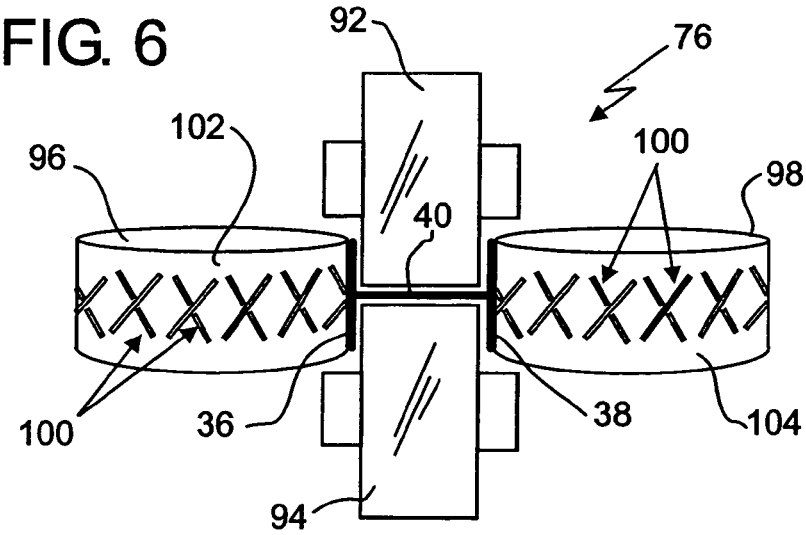
FIG. 6, is a schematic illustration of one embodiment of a rolling mill stand which may be used in the embodiment of FIG. 5.

FIG. 6 is a simplified, end view schematic elevation of a representative configuration of the finishing mill 76 for applying the relief design 54 to the H pile 34 of FIG. 1. In FIG. 6 the H pile 34 is positioned with its web 40 pinched between the mill's horizontal rollers 92, 94 and its flanges 36, 38 in contact with the mill's opposite side vertical rollers 96, 98. A novel aspect of the mill 76 is that the vertical rollers 96, 98 are here adapted to perform the dual function of finish rolling the surfaces 42 and 44 of the flanges 36, 38, but in addition they also emboss the relief design 54 into each rolled surface. The embossing and finish rolling is performed in a single pass through the mill 76.

As shown each of the modified vertical rollers 96, 98, here referred to as embosser rollers, include one or more engravings 100, each engraving comprising the negative of an object 58 of the relief 54 (FIG. 1). In the best mode embodiment the engravings 100 are machined into the flat surface areas 102, 104 of rollers 96, 98 and are provided to a depth which is greater in magnitude than the desired maximum projected heights of the relief design objects 58. This ensures that the finishing mill can provide the desired projection height despite the wearing of the roller flat surfaces 102, 104. The engravings 100 may be machined into the surfaces 102, 104 of the embosser rollers 96, 98 in any of several methods known to those skilled in the art. Similarly such other suitable methods of providing the engravings as may be known to those skilled in the art, apart from machining, may also be sued.

Figure 13:
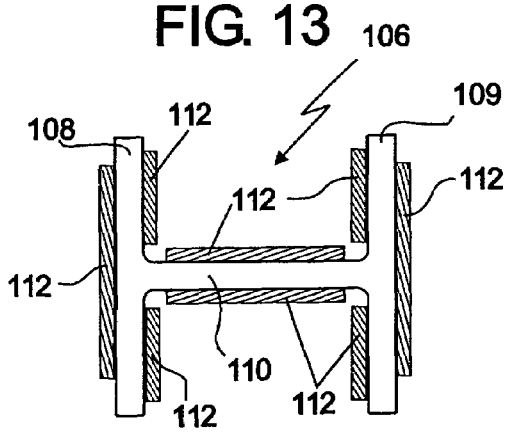
FIG. 13, is an illustration of the cross section profile of the steel H pile of the present invention, as used in the description of the manufacturing method of the present invention.

As described earlier, and in greater detail below, the present invention is not limited in the type of relief design object embossed into the H pile surfaces or their location on the H pile. As described with respect to FIG. 1 the exposed surfaces of the H pile 34 include the outer surfaces 42, 44 of the flanges 36, 38, the inner surfaces 46-49 of the flanges, and the surfaces 50, 52 of the web 40. According to the present invention any of these surfaces may be embossed with relief designs to similarly increase their surface areas and the overall frictional forces of the H Piling. FIG. 13 shows a cross section profile of an H piling 106, with flanges 108, 109 and web 110, and sectioned areas 112 which schematically represent relief designs embossed in all available surface areas of the H Piling.

Figure 8:
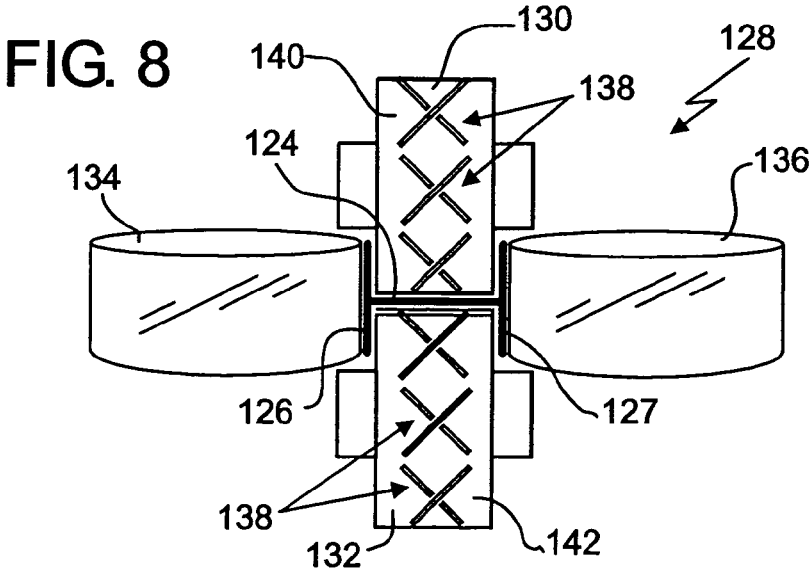
FIG. 8, is a schematic illustration of an alternative embodiment of the rolling mill stand of FIG. 6.
Figure 7:
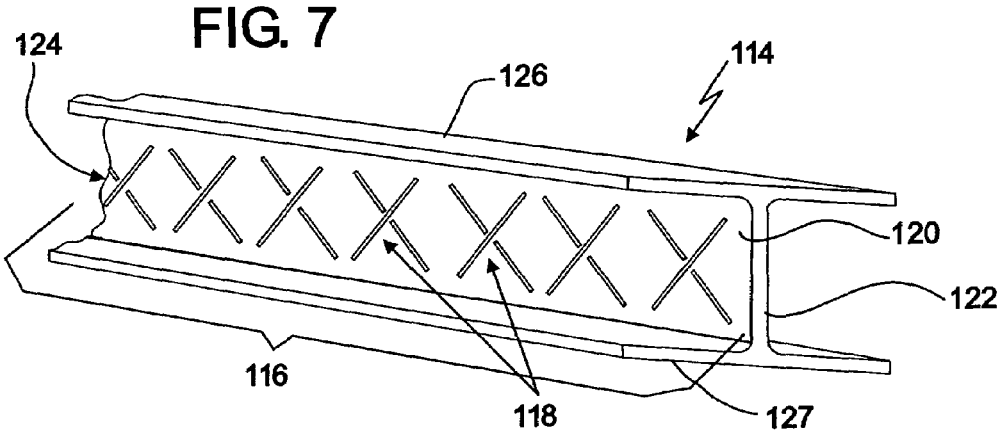
FIG. 7, is a perspective illustration, not to scale, of an alternative embodiment of a steel H pile according to the present invention.

To illustrate, FIG. 7 is a perspective illustration of a section of an H pile 114 in which a relief design 116 with similar "X" character design objects 118 are embossed onto the exposed surfaces 120, 122 (not shown) of the pile's web 124. In this embodiment it is assumed that the surfaces of the flanges 126, 127 have no embossed relief design. This H pile embodiment may be achieved with modification of the finish mill 76 (FIG. 5), as shown in FIG. 8. There, in a simplified, end view schematic elevation of an alternative configuration finishing mill 128 for applying the relief design 116 of FIG. 7, the H pile 114 is positioned with its web 124 pinched between horizontal embosser rollers 130, 132 and its flanges 126, 127 in contact with the mill's opposite side vertical rollers 134, 136.

As with the embosser rollers 96, 98 of the finishing mill 76 of FIG. 6, the embosser rollers 130, 132 simultaneously perform the single pass finish rolling and embossing of the relief design 116 into the rolled surfaces 120, 122 of the web 124. The rollers 130, 132 also include one or more engravings 138 which comprise the negative of the object 118 of the embossed relief design 116 (FIG. 7). As with the engravings 100 of embosser rollers 96, 98 (FIG. 6) the engravings 138 are also preferably machined into the flat surface areas 140, 142 of rollers 130, 132. They are also engraved to a depth greater in magnitude than the desired maximum projected heights of the relief design objects 118 to ensure that the desired object projection height is achieved despite roller surface wear. The engraving may be machined into the surfaces 140, 142 of the embosser rollers 130, 132 using any of several machining methods known to those skilled in the art. Similarly such other suitable methods of providing the engravings as may be known to those skilled in the art, apart from machining, may also be sued.

Figure 9:
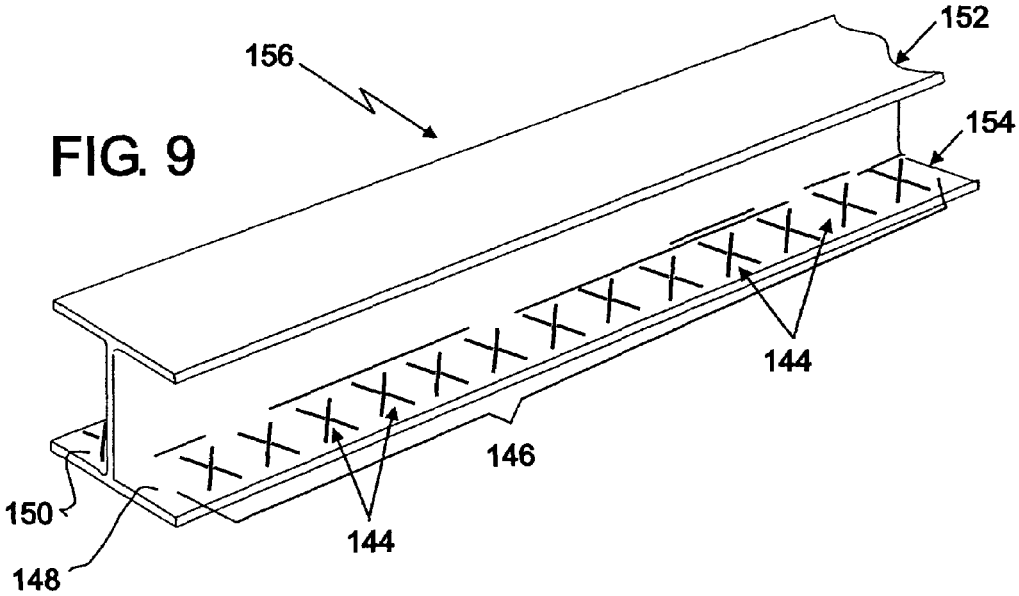
FIG. 9, is a perspective illustration, not to scale, of yet a further alternative embodiment of a steel H pile according to the present invention.

FIG. 9 illustrates the embossing of X character design objects 144 in a relief design 146 on the inside surfaces 148, 150 of the flanges 152, 154 of an H pile 156. At present this is somewhat fanciful since current configuration rolling mills are not capable of embossing the inside flange surfaces (148, 150) without significant modifications. The purpose here, however, is to emphasize the fact that the present invention is not limited in the form or location of the embossed relief design.

While the making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the instant invention.

Although the invention has been shown and described with respect to a best mode embodiment thereof, it should be understood by those skilled in the art that various changes, omissions, and additions may be made to the form and detail of the disclosed embodiment without departing from the spirit and scope of the invention, as recited in the following claims.

What is claimed is:

1. An H pile for use in building foundations, where the pile is inserted into earth to support structural loads, said H pile comprising:

at least two substantially parallel flanges interconnected by a web, said flanges and said web each having major surfaces thereon, each said major surface having an axial length; and a relief design, having one or more relief design objects embossed on a majority portion of one or more of said major surfaces, said relief design objects each providing thereon surface irregularities in the form of letter X characters which increase the surface friction of each embossed major surface, wherein when said H pile is inserted into earth, said X characters increase the surface friction of said H Pile with the earth thereby increasing the pile load bearing capacity of the H pile.

2. The H pile of claim 1, wherein said relief design is embossed along the whole or any portion of the axial length of said major surfaces.

3. The H pile of claim 2, wherein said letter X characters each project to a selected height above the base plane of each said embossed major surface to provide said surface irregularities.

4. The H pile of claim 3, wherein said relief design objects are formed in any one or more of a plurality of user selected letter X character sizes.

5. The H pile of claim 3, wherein said relief design objects are arrayed on each said embossed major surface in any one or more of a plurality of selected relief design patterns.

6. The H pile of claim 5, wherein said selected relief design pattern may be provided in any desired unit area density.

7. The H pile of claim 3, wherein said relief design objects project above the base plane of each said major surface at a height of from substantially 0.04 inches (1millimeter) to substantially 1.5 inches (38 millimeters).

8. An H pile for use in building foundations, where the pile is inserted into earth to support structural loads, said H pile comprising:

at least two substantially parallel flanges, each said flange having one or more flange major surfaces; and a web interconnecting said flanges, said web having one or more web major surfaces;

wherein one or more of said flange major surfaces and, alternately, one or more of said web major surfaces and, alternately one or more of said flange major surfaces in combination with one or more of said web major surfaces, having one or more relief design objects embossed on a majority portion thereof, each said relief design object providing a surface irregularity in the form of a letter X character, wherein when said H pile is inserted into earth, said X characters increase the surface friction of said H Pile with the earth thereby increasing the friction pile load bearing capacity of the H pile.

* * * * *